United States Patent [19]

Lindahl et al.

[11] 4,152,197

[45] May 1, 1979

[54] PROCESS FOR PREPARING HIGH-YIELD CELLULOSE PULPS BY VAPOR PHASE PULPING AN UNPULPED PORTION OF LIGNOCELLULOSIC MATERIAL AND A PARTIALLY CHEMICALLY PULPED PORTION

[75] Inventors: Jonas A. I. Lindahl, Domsjoverken; Lars G. Rudstrom, Husum, both of Sweden

[73] Assignee: Mo och Domsjo AB, Ornskoldsvik, Sweden

[21] Appl. No.: 792,941

[22] Filed: May 2, 1977

Related U.S. Application Data

[63] Continuation of Ser. No. 615,626, Sep. 22, 1975, abandoned.

[30] Foreign Application Priority Data

Sep. 23, 1974 [SE] Sweden ..... 7411950

[51] Int. Cl.[2] ..... D21C 1/02; D21C 3/26; D21D 1/30

[52] U.S. Cl. ..... 162/19; 162/20; 162/28; 162/65; 162/68; 162/82; 162/84; 162/142; 162/149; 162/241

[58] Field of Search ..... 162/20, 28, 25, 27, 162/55, 65, 141, 142, 234, 241, 237, 19, 82, 149, 83, 84, 63, 68

[56] References Cited

U.S. PATENT DOCUMENTS

| | | | |
|---|---|---|---|
| 2,660,097 | 11/1953 | Hill | 162/28 X |
| 2,913,362 | 11/1951 | Cusi | 162/25 X |
| 2,963,086 | 12/1960 | Green | 162/241 |
| 2,993,537 | 7/1961 | Green | 162/237 |
| 3,041,232 | 6/1962 | Richter et al. | 162/237 X |
| 3,238,088 | 3/1966 | Villavieencio et al. | 162/28 X |
| 3,382,140 | 5/1968 | Henderson et al. | 162/28 |
| 3,446,699 | 5/1969 | Asplund et al. | 162/28 X |
| 3,578,554 | 5/1971 | Richter | 162/55 X |
| 3,664,918 | 5/1972 | Clayton et al. | 162/19 |
| 3,769,152 | 10/1973 | Samuelson et al. | 162/65 |
| 3,830,689 | 8/1974 | Rautalahati et al. | 162/61 |

OTHER PUBLICATIONS

Rydholm; Pulping Processes, p. 283, Interscience Publishers, N.Y. 1965.

*Primary Examiner*—S. Leon Bashore
*Assistant Examiner*—Steve Alvo

[57] ABSTRACT

Process and apparatus are provided for the preparation of improved high-yield cellulose pulps, such as semi-chemical, chemimechanical, thermomechanical, and mechanical pulps, which comprises mechanically defibrating a mixture of particulate lignocellulosic materials which have been partially pulped and softened to different extents. Part of the raw lignocellulosic material is particulate form is washed, moistened with steam, impregnated with pulping chemicals and pulped to a yield of from about 65 to about 92%. Another part is treated in similar manner but either not pulped at all or, if pulped, pulped to a lesser extent. The two parts are mixed without intermediate washing, after which the mixture is subjected to a vapor phase pulping by heating to a temperature within the range from about 90 to about 200° C. under pressure to obtain softening of the lignin, and delignification, after which the resulting product is mechanically defibrated to form cellulose pulp.

26 Claims, 3 Drawing Figures

A
B
1
2
3
4
5
6
7
8
9
10
11
12
13
14
15
16
17
19
20
21
22
23
24
25
26
27

PROCESS FOR PREPARING HIGH-YIELD CELLULOSE PULPS BY VAPOR PHASE PULPING AN UNPULPED PORTION OF LIGNOCELLULOSIC MATERIAL AND A PARTIALLY CHEMICALLY PULPED PORTION

This is a continuation of application Ser. No. 615,626 filed Sept. 22, 1975 now abandoned.

Using known techniques it is possible to prepare from Scandinavian softwoods such as spruce, strong chemimechanical cellulose pulps in high yields of about 85%. These pulps are however quite difficult to bleach. Moreover, the pulp fibers are extremely resistant to further refining or beating, and hence it is difficult to improve their mechanical strength for the preparation of paper. The paper produced from such pulp also has a rough surface, which renders it less suitable for use as writing and printing paper. In addition, the paper has a low opacity.

When the yield is increased using known techniques to approximately 90% or higher, a cellulose pulp is obtained that is more suited for the manufacture of paper, and that can be bleached comparatively easily. However, the mechanical strength is so reduced that unless a stronger cellulose pulp is mixed with it, such softwood pulp is unsuitable for the manufacture of writing and printing paper.

High-yield cellulose pulps can be produced from hardwoods at a pulp yield of approximately 90% or more. A readily bleached but extremely weak pulp is obtained. At a pulp yield of approximately 85% or less, a strong pulp is obtained, which is less difficult to beat, and which can be readily bleached with a lignin-preserving bleaching agent such as hydrogen peroxide.

Accordingly, it has been proposed that cellulose pulps from softwoods and cellulose pulps from hardwoods be mixed, in order to improve the properties of each, and overcome their disadvantages. However, this is not practical, because such different pulps must be manufactured by completely different methods and then mixed together, which is not an economic procedure, since it requires doubling the equipment and space requirements.

To avoid this, it has been proposed that such high-yield pulps be prepared by pulping mixtures of raw particulate hardwood and softwood. This however is unsatisfactory, because the two kinds of woods really require different pulping conditions. It has been found difficult to obtain pulps of high strength, which give papers of good surface smoothness.

In accordance with the invention, high-yield pulps having a yield within the range from about 70 to about 93% are prepared from raw lignocellulosic material by mechanical defibration of mixtures of at least two portions of particulate lignocellulosic material, of which one has been pulped so that one is softer than the other. The lignocellulosic material can be of the same type or of different types.

The process of the invention comprises heating under pressure a mixture of at least two portions of particulate lignocellulosic material, at least one of which is unpalped and the other is partially pulped; and then subjecting the heat-treated mixture of portions of lignocellulosic material, of which one portion is softer than the other, to mechanical defibration.

The process of the invention includes a number of premutations in optional process steps.

However before heating under pressure, one portion of lignocellulosic material is always:

(a) washed
(b) moistened with steam
(c) impregnated
(d) partially pulped while another portion of lignocellulosic material is always:

(a) washed and, in addition,
(b) either;
  (i) moistened with steam or;
  (ii) moistened with steam and impregnated This portion is never separately pulped.

The separation of the particulate lignocellulosic material may take place:

(a) before the washing
(b) after the washing
(c) after the washing and steam-moistening In one embodiment of the process of the invention, one portion of the raw lignocellulosic material in particulate form is washed, moistened with steam, impregnated with pulping chemicals, then pulped to a yield within the range from about 65 to about 92%, preferably from about 78 to about 88%, and then mixed without intermediate washing with another portion of lignocellulosic material which has been impregnated with pulping chemicals but not pulped. The mixture is heated to a temperature within the range from about 90° to about 200° C., preferably from about 100° to about 185° C., under pressure, to obtain a second partial delignification and softening of the first portion of lignocellulosic material, after which the partially delignified mixture of chips is mechanically defibrated.

In a preferred embodiment of the invention, the second portion of lignocellulosic material is also moistened with steam at a temperature within the range from about 90° C. to about 110° C. for at least five minutes, and impregnated with pulping chemicals, so that a certain delignification and softening is obtained after mixture with the first portion during heating of the mixture of the materials under pressure.

The heating under pressure is effected so that the final yield of the first portion of lignocellulosic material is within the range from about 60 to about 88%, preferably from about 73 to about 85%, and the yield of the second portion of lignocellulosic is within the range from about 85% to about 100%, preferably from about 90 to about 96%. In order to achieve yields within these ranges, the material mixture should be heated under pressure for about 1 to about 20 minutes, and preferably from about 2 to about 10 minutes.

The yield is a good measure of the extent of delignification and is determined with an accuracy of ±1%. The yields of the two portions can be determined after they have been mixed using the following procedure, exemplified for a 1:1 mixture:

(1) Each portion, the first and the second, is processed separately through all the stages, and the yields are determined:

for the first portion:
  (1) after the digestion
  (2) after the heating under pressure for the second portion:
  (1) before the heating under pressure
  (2) after the heating under pressure The total yield is then calculated using 50% of the first portion yield and 50% of the second portion yield. This separate processing of the first and second portions is then repeated using minimum and maximum treatment conditions and different types of raw materials. Finally the first and second portions are processed according to the invention, i.e., the first and second portions are mixed 1:1, and the process carried out on the mixture. Yield determinations are carried out as above. The results obtained correspond to those previously obtained and to the calculated ones. The results are therefore considered to be correct and dependable.

Prior to the pulping of the first portion of lignocellulosic material, it is particularly suitable to impregnate the material with pulping chemicals, and to remove the excess pulping chemicals prior to the second pulping under pressure.

After the mixture of particulate materials has been partially delignified under pressure, the resulting product is mechanically defibrated, and optionally subjected to an additional mechanical defibration or refining process, and optionally also to a bleaching process, preferably with a lignin-preserving bleaching agent such as hydrogen peroxide.

The process of the invention is applicable to any kind of wood. In general, hardwood such as beech and oak is more costly than softwood, such as spruce and pine, but both types of wood can be pulped satisfactorily using this process. Exemplary hardwoods which can be pulped include birch, beech, poplar, cherry, sycamore, hickory, ash, oak, chestnut, aspen, maple, alder and eucalyptus. Exemplary softwoods include spruce, fir, pine, cedar, juniper, and hemlock.

In the process of the invention, mixtures of two or more hardwoods and softwoods, of two or more hardwoods, and of two or more softwoods, can be processed to form cellulose pulps of superior paper-making properties.

In the case of wood, it is preferred that the material be in the form of small pieces. Subdivision of the wood into chip form can be done in a chipper, which should provide chips having a size within the range from about 15 to 30 mm by from about 20 to 40 mm, with a thickness of from about 0.5 to about 10 mm. The use of thin chips having a thickness from about 0.5 and about 5 mm is particularly suitable, since this facilitates the penetration of the pulping chemicals into the lignocellulosic material.

In accordance with the invention, the particulate lignocellulosic material is washed at least once prior to treatment with steam in order to remove contaminants, such as pieces of metal, stones, dirt, etc., which may be attached to the chips. During washing, elevated temperatures can be used. In a pulp mill, surplus heat from the pulp manufacturing process and friction heat from the refiners can be used to heat the washing liquid or for other purposes outside the mill. Washing the chips at elevated temperatures give a more effective wash, and the heated chips do not require as long a residence time in the subsequent steam treatment stage. An equalization of the moisture content of the chips is also obtained, which in turn results in a pulp of more uniform quality.

Following the washing, at least one portion of the chips is steam treated. Another portion can be, but need not be. At least one of the portions of chips is always impregnated with pulping chemicals subsequent to washing and steam-moistening and then pulped and passed to the common pressure vessel. Another portion of chips may be passed to the common pressure vessel directly subsequent to its washing or subsequent to washing and steam-moistening. Alternatively, this second portion after washing and steam-moistening also may be impregnated with pulping chemicals prior to being passed to the common pressure vessel. This second portion of chips is, however, not subjected to any separate pulping operation. In the common pressure vessel one portion of the material, the one previously digested, may optionally be further delignified and another portion may here be delignified for the first time on its route through the stages of the process. One portion of chips is thus pulped to a lesser or greater extent than the other, so that the two portions are not at the same pulping stage when leaving the common pressure vessel; one is harder than the other.

The separate pulping of the first portion is carried out at a temperature within the range from about 100° to about 180° C., for from about 2 to about 240 minutes.

In the impregnation stages any pulping chemicals can be used, for example, chemicals for a sulfate or sulfite pulping, or an oxygen gas/alkali pulping, such as aqueous sodium hydrosulfide solution, aqueous sodium hydroxide, aqueous sodium polysulfide solution, having a pH from about 2 to about 13, preferably from about 5 to about 9.

The pulping liquor employed for the first and second partial digestions of the chips in accordance with the invention accordingly can comprise any alkaline material as the alkali, including not only sodium hydroxide but also sodium bicarbonate, ammonium hydroxide, and magnesium hydroxide. The pulping can be carried out using sulfur dioxide, or oxygen gas and alkali, if desired. The proportions of the pulping chemicals in the liquor is likewise not critical, and can be varied as desired. The chips are impregnated to about 100% by weight of pulping chemicals solution.

Following the first pulping stage, without an intermediate washing, the two portions of material, of which at least one is partially pulped, and then combined, after which the mixture is subjected to a partial pulping stage by treating at a superatmospheric pressure within the range from about 1 to about 11 atmospheres, preferably within the range from about 1.5 to about 9 atmospheres, at a temperature within the range from about 90° to about 200° C., preferably from about 100 to about 185° C., for from about 1 to about 20 minutes.

If desired, the portion of lignocellulosic material not partially digested can be impregnated with pulping chemicals prior to being combined and subjected to the common pulping stage.

Figure 1:
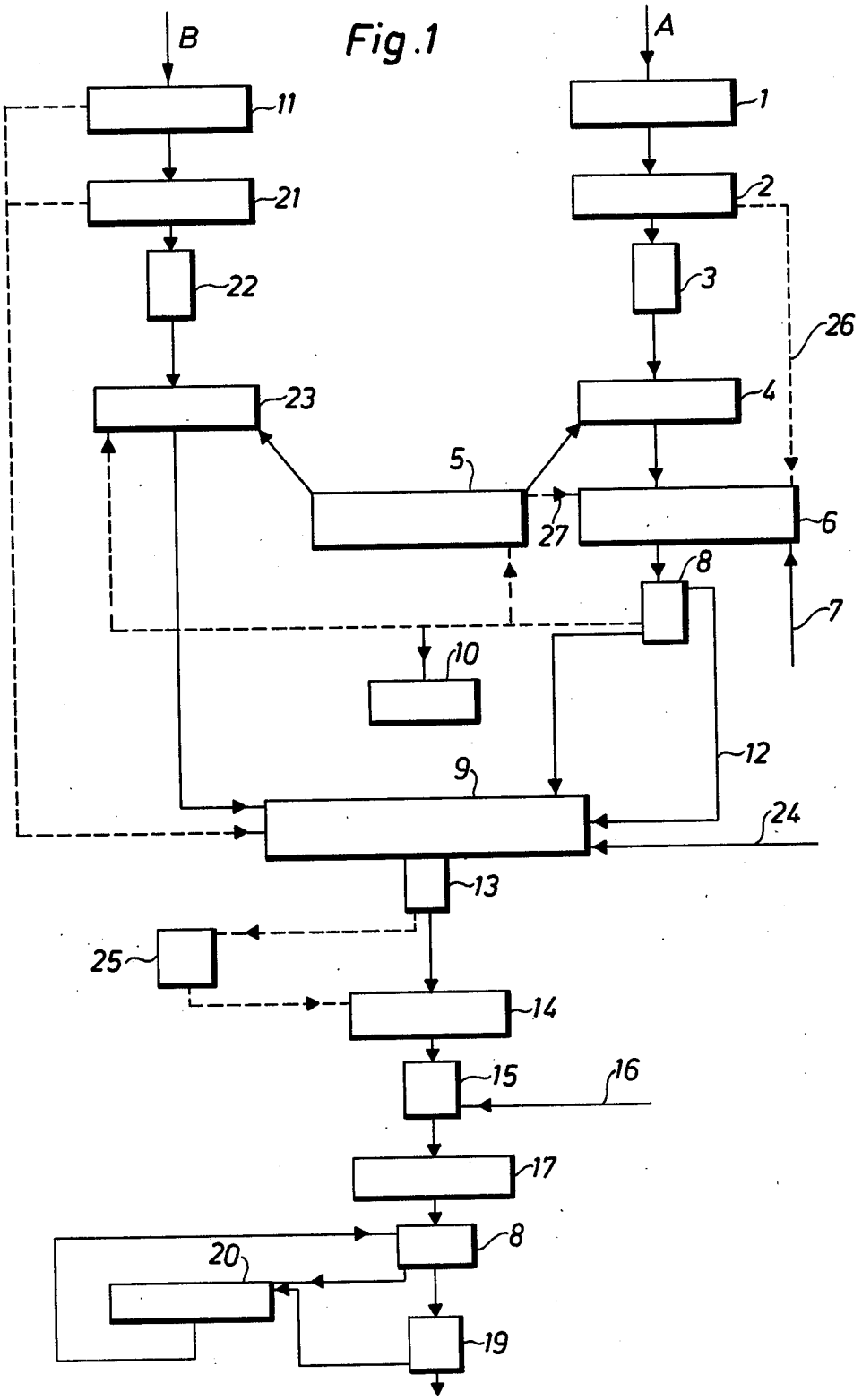
FIG. 1 is a flow sheet which shows the various steps in the process of the invention.

The following Examples are illustrative of preferred embodiments in accordance with the invention.

The difficulties in obtaining pulps of high strength which give papers of acceptable surface smoothness from hardwood and softwood and mixtures thereof when using the processes known prior to this invention are illustrated by the experiments described below as Controls 1, 2, and 3.

CONTROL 1

Digestion of the same type of softwood (long fiber wood) to different yields.

Spruce chips having a length of approximately 30 mm, a width of approximately 15 mm, and a thickness of approximately 3 mm were washed and moistened with steam at atmospheric pressure for ten minutes. The chips were then pressed in a laboratory press, and allowed to expand by absorption of aqueous pulping liquor comprising 50 g/l sodium hydroxide calculated as $Na_2O$, and sulfur dioxide $SO_2$ in an amount of 65 g/l. The pH of this solution was 6.0. The chips absorbed 1,000 ml of this solution per 1,000 g of dried chips.

The impregnated chips were then charged to a digester, and heated with saturated steam to 170° C. and a pressure of 8.4 kp/cm$^2$ to obtain a partial digestion.

The first batch (A) of chips was digested for 5 minutes at 170° C. The second batch (B) was digested for 25 minutes at 170° C. Each of these digestion times can be considered as the total digestion time, since the time needed to reach maximum digestion temperature was less than 1 minute. The chips in batches A and B were defibrated separately in a disc refiner under digester pressure, with the simultaneous addition forming an aqueous pulp suspension in dilution water of the defibrated pulp from the refiner. The defibrated pulp was then blown to a hydrocyclone, to separate steam from the pulp suspension. The consistency of the resulting pulp suspension was approximately 30%, and the temperature was 87° C. The defibrated pulp was then refined in a second disc refiner. Dilution water was added in the second disc refiner to a pulp consistency of approximately 23% during the refining. The refined pulp was then cleaned and dewatered to a pulp consistency of approximately 35%, after which it was bleached with 3% hydrogen peroxide and 0.8% sodium dithioate. The pulp suspension was then beaten 1,000 revolutions in a laboratory PFI mill, and formed into laboratory sheets in order to test the properties of the pulp and its suitability for the manufacture of paper. The following results were obtained:

TABLE I

| | Pulp Batch A | Pulp Batch B |
|---|---|---|
| Pulp yield % | 91.2 | 84 |
| Degree of beating, Schopper-Riegler | 56.5 | 15 |
| Brightness after bleaching, SCAN, % | 77.4 | 70.7 |
| Breaking length, meters | 4200 | 6800 |
| Tear factor | 72 | 84 |
| Light scattering coefficient, m$^2$/kg | 36.7 | 21.4 |
| Air permeability, SCAN P26:68, ml/min | 980 | 2300 |

The results show that Batch A had a higher degree of beating and brightness than Batch B, demonstrating that the pulp of Batch A is more readily beaten and bleached. The pulp of Batch A also had a better opacity, which is determined by measuring the light scattering coefficient, and is directly proportional thereto. On the other hand, the pulp of Batch B had a higher mechanical strength.

The paper from Batch B had an unacceptable writing surface, as shown by the high permeability.

CONTROL 2

Digesting the same type of hardwood (short fiber wood) to different yields.

Control 1 was repeated, with the difference that birch chips were used instead of spruce. All other processing conditions were the same. The following results were obtained:

TABLE II

| | Pulp Batch A | Pulp Batch B |
|---|---|---|
| Pulp yield % | 93.0 | 84.2 |
| Degree of beating, Schopper-Riegler | 12.5 | 18 |
| Brightness after bleaching, SCAN % | 81.5 | 80.7 |
| Breaking length, meters | 270 | 4900 |
| Tear factor | 13 | 63 |
| Light scattering coefficient, m$^2$/kg | 37.5 | 31.3 |
| Air permeability SCAN-PG26:68, ml/min | >3000 | 1173 |

The results show that hardwood treated in accordance with the conventional procedure at a high yield provides a pulp which although readily bleached has an extremely low mechanical strength. When the pulp yield is reduced to 84.2%, as in Batch B the strength of the pulp is improved considerably, while the pulp is still readily bleached, and less difficult to beat. The papers from each batch were not acceptable for writing, as shown by the high permeability.

CONTROL 3

Digesting mixtures of softwood and hardwood to high yield.

Batch A, a mixture of 50% birch chips and 50% spruce chips by weight, the chips having the same dimensions as given in Control 1 except that the chip thickness was 2 mm, was moistened with steam and impregnated with pulping liquor in the manner recited in Control 1. The mixture of chips was then pulped at 160° C. for 20 minutes. The partially delignified chips were defibrated, refined, and bleached, as described in Control 1. The pulp obtained was beaten 500 revolutions in a laboratory PFI mill, and laboratory sheets then formed. The sheets were tested to determine their paper properties.

The second Batch B of chips was a mixture of 50% birch and 50% pine chips. This batch was treated under exactly the same conditions. The following results were obtained:

TABLE III

| | Batch A Spruce Chips | Batch B Pine Chips |
|---|---|---|
| Pulp yield % | 89.0 | 89.5 |
| Degree of beating, Schopper-Riegler | 40.5 | 14.5 |
| Brightness after bleaching, SCAN % | 78.4 | 77.5 |
| Breaking length, meters | 3900 | 3100 |
| Tear factor | 68 | 63 |
| Light scattering coefficient, m$^2$/kg | 36.1 | 33.4 |
| Air permeability, SCAN-P26:68 | 1560 | >3000 |

The results show that both pulps were readily bleached, and had good light-scattering properties. The mechanical strength of the pulp was lower however than that of a pulp produced solely from softwood, i.e., spruce chips, Control 1, at a corresponding yield. The surface smoothness of paper produced from this pulp would be unacceptably low, as apparent from the high permeability. These pulps gave a hard and brittle paper, having poor stretch and strain properties.

The effectiveness of the process and apparatus of the present invention in overcoming the disadvantages of the known pulps as described above is illustrated in the following Examples.

EXAMPLE 1

The manufacture of chemimechanical pulp from two different types of wood, birch and spruce, of which the birch chips are pulped more, using the process of FIG. 1.

Technical grade birch chips having an approximate size of 30 by 15 mm and a thickness of 5 mm (designated chip stream A in the flow sheet of FIG. 1) were washed in a chip washer 1, and moistened with steam in a steam-moistening vessel 2 at atmospheric pressure and a temperature of 100° C. for ten minutes. The steam-moistened chips were then passed to an impregnating vessel 4 by way of a screw feeder 3, so constructed that the chips were compressed while they were being transported to the vessel 4, so that en route they were dewatered from a moisture content of approximately 65% to a moisture content of approximately 50%. Subsequent to the passage through the screw feeder, the chips were allowed to expand in the impregnating vessel 4, while they were absorbing pulping liquor. The pulping liquor was passed to the vessel from a chemical preparation stage 5, and maintained at constant level in the vessel 4. As the chips swelled in the impregnation vessel, they absorbed approximately one liter of digestion liquor for each kilogram of chips. The pulping liquor comprised sulfur dioxide in admixture with sodium hydroxide, the amount of sodium hydroxide being 50 g/l, calculated as $Na_2O$ and the amount of sulfur dioxide being 65 g/l. The pulping liquor had a pH of 6.0.

The impregnated chips were then passed to the digester 6, in which they were subjected to a vapor phase pulping process by supplying steam directly thereto at a superatmospheric pressure of 7.5 kp/cm$^2$ through the line 7, giving a pulping temperature of 170° C. in the digester 6. The chips were held in the digester 6 for twenty minutes.

Following the digestion, the chips were fed to the pressure vessel 9 by means of a screw feeder 8, which was of the same construction as the screw feeder 3, and which expressed surplus pulping liquor and steam from the chips. The pulping liquor thus recovered could be used for impregnating the second stream of spruce chips, designated as B in FIG. 1, in an impregnating vessel 23, or for preparing fresh pulping liquor in the chemical preparing stage 5, or passed directly to an apparatus 10 for recovery of spent pulping chemicals.

After the digestion the chip stream A from the digester 6 had a pulp yield of 83%.

The stream of spruce chips designated as B in FIG. 1 was of chips having the same dimensions as the birch chips of stream A. The chips were passed directly to the common pressure vessel 9, after being washed in the chip washer 11. The chips in stream B were mixed in the pressure vessel 9 with the chips from stream A in equal proportions by weight.

Excess steam was fed to the pressure vessel 9 through the line 12 from the screw feeder 8 at a superatmospheric pressure of 2.5 kp/cm$^2$.

In the pressure vessel 9, the mixture of chips A and B were subjected to a delignification in the vapor phase at a temperature of 125° C. for three minutes. Under these conditions, the stream of chips B was brought to a pulp yield of approximately 95%. The resulting steam-heated mixture of partially delignified chips A and only very slightly delignified chips B was then passed to a defibrator 14, a disc refiner, by means of a screw feeder 13 at the bottom of the pressure vessel 9. The chips were defibrated in the defibrator 14 at a superatmospheric pressure of 2 kp/cm$^2$. at a temperature of approximately 120° C. The defibrated pulp was then passed to the hydrocyclone 15, for separating steam from the pulp cooling water being passed to the hydrocyclone through the line 16.

From the cyclone, the pulp was fed to a further disc refiner 17, where the pulp was further refined at atmospheric pressure, and at a temperature of approximately 85° C. and a pulp concentration of 25%. The pulp was then screened while being diluted with water in a pressure screen 18 at a 1% pulp consistency. The screened pulp was then cleaned in a vortex cleaner 19.

The rejects fraction from the pressure screen 18 and the vortex cleaner 19 was dewatered to a pulp consistency of 20%, and then refined in the refiner 20. The refined rejects fraction pulp was returned to the pressure screen 18.

The accepts fraction from the pressure screen 18 and the vortex cleaner 19 was dewatered to a pulp consistency of 20%, and bleached with hydrogen peroxide.

The total yield of pulp thus obtained was 87%, and the brightness, 78% SCAN. The strength and optical properties of the pulp were such that the pulp could be used for the manufacture of writing and printing paper.

EXAMPLE 2

The manufacture of chemimechanical pulp from five different types of wood, of which birch-aspen-beech chips are pulped more, using the process of FIG. 1.

A mixture of birch chips, aspen chips, and beech chips in the proportion of 40:40:20 designated chip stream A in the flow sheet of FIG. 1 was washed in a chip washer 1 and moistened with steam in a steam-moistening vessel 2 at atmospheric pressure and a temperature of 100° C. for ten minutes. The steam-moistened chips were then passed to an impregnating vessel 4 by way of a screw feeder 3, so constructed that the chips were compressed while they were being transported to the vessel 4, so that they were dewatered from a moisture content of approximately 65% to a moisture content of approximately 50%. Subsequent to the passage through the screw feeder, the chips were allowed to expand in the impregnating vessel 4, while they were absorbing pulping liquor. The pulping liquor was passed to the vessel from a chemical preparation stage 5, and maintained at constant level in the vessel 4. As the chips swelled in the impregnation vessel, they absorbed approximately one liter of digestion liquor for each kilogram of chips. The pulping liquor comprised sulfur dioxide in admixture with sodium hydroxide, the amount of sodium hydroxide being 50 g/l, calculated as $Na_2O$, and the amount of sulfur dioxide being 65 g/l. The pulping liquor had a pH of 6.0.

The impregnated chips were then fed to digester 6, in which they were subjected to a vapor phase pulping process by supplying the stream directly thereto at a superatmospheric pressure of 7.5 kp/cm$^2$ through the line 7, giving a pulping temperature of 170° C. in the digester 6. The chips were held in the digester 6 for twenty minutes.

Following the digestion, the chips were fed to the pressure vessel 9 by means of a screw feeder 8, which was of the same construction as the screw feeder 3, and which expressed surplus pulping liquor and steam from the chips. The pulping liquor thus recovered could be used for impregnating the second stream of chips, designated as B in FIG. 1, in an impregnating vessel 23, or for preparing fresh pulping liquor in the chemical preparing stage 5, or passed directly to an apparatus 10 for recovery of spent pulping chemicals.

After the digestion, the chip stream A from the digester 6 had a pulp yield of 83%.

The stream of chips designated as B in FIG. 1 was a mixture of pine and spruce chips in the proportion 60:40, the chips having the same dimensions as the chips of stream A. The chips were passed directly to the common pressure vessel 9, after being washed in the chip washer 11. The chips in stream B were mixed in the pressure vessel 9 with the chips from stream A, in equal proportions by weight.

Excess steam was fed to the pressure vessel 9 through the line 12 from the screw feeder 8 at a superatmospheric pressure of 2.5 kp/cm$^2$.

In the pressure vessel 9, the mixture of chips A and B were subjected to a delignification in the vapor phase at a temperature of 125° C. for three minutes. Under these conditions, the stream of chips B was brought to a pulp yield of approximately 95%. The resulting steam heated mixture of partially delignified chips A and only very slightly delignified chips B were then passed to a defibrator 14, a disc refiner, by means of the screw feeder 13 at the bottom of the pressure vessel 9. The chips were defibrated in the defibrator 14 at a superatmospheric pressure of 2 kp/cm$^2$ at a temperature of approximately 120° C. The defibrated pulp was then passed to the hydrocyclone 15, for separating steam from the pulp, cooling water being passed to the hydrocyclone through the line 16.

From the cyclone, the pulp was led to a further disc refiner 17 where the pulp was further refined at atmospheric pressure at a temperature of approximately 85° C. and a pulp concentration of 25%. The pulp was then screened while being diluted with water in a pressure screen 18 at a 1% pulp consistency. The screened pulp was then treated in a vortex cleaner 19.

The rejects fraction from the pressure screen 18 and the vortex cleaner 19 was dewatered to a pulp consistency of 20% and then refined in the refiner 20. The refined rejects fraction pulp was returned to the pressure screen 18.

The accepts fraction from the pressure screen 18 and the vortex cleaner 19 was dewatered to a pulp consistency of 20%, and bleached with hydrogen peroxide.

The total yield of pulp thus obtained was 87%, and the brightness, 77% SCAN. The strength and optical properties of the pulp were such that the pulp could be used for the manufacture of writing and printing paper and cardboard.

EXAMPLE 3

The manufacture of chemimechanical pulp from one type of wood, spruce, using the process of FIG. 1.

Technical grade spruce chips having an approximate size of 30 by 15 mm and a thickness of 5 mm (designated chip stream A in the flow sheet of FIG. 1) were washed in a chip washer 1 and moistened with steam in a steam moistening vessel 2 at atmospheric pressure and a temperature of 100° C. for ten minutes. The steam-moistened chips were then passed to an impregnating vessel 4 by way of a screw feeder 3, so constructed that the chips were compressed while they were being transported to the vessel 4, so that they were dewatered from a moisture content of approximately 65% to a moisture content of approximately 50%. Subsequent to the passage through the screw feeder, the chips were allowed to expand in the impregnating vessel 4 while they were absorbing pulping liquor. The pulping liquor was passed to the vessel from a chemical preparation stage 5, and maintained at constant level in the vessel 4. As the chips swelled in the impregnation vessel, they absorbed approximately one liter of digestion liquor for each kilogram of chips. The pulping liquor comprised sulfur dioxide in admixture with sodium hydroxide, the amount of sodium hydroxide being 50 g/l calculated as $Na_2O$, and the amount of sulfur dioxide being 65 g/l. The pulping liquor had a pH of 6.0.

The impregnating chips were then fed to the digester 6, in which they were subjected to a vapor phase pulping process by supplying the steam directly thereto at a superatmospheric pressure of 7.5 kp/cm$^2$ through the line 7, giving a pulping temperature of 170° C. in the digester 6. The chips were held in the digester 6 for twenty minutes.

Following the digestion, the chips were fed to the pressure vessel 9 by means of a screw feeder 8, which was of the same construction as the screw feeder 3, and which en route pressed surplus pulping liquor and steam from the chips. The pulping liquor thus removed could be used for impregnating the second stream of spruce chips, designated as B, in FIG. 1 in an impregnating vessel 23, or for preparing fresh pulping liquor in the chemical preparing stage 5, or passed directly to an apparatus 10 for recovery of spent pulping chemicals.

After the digestion, the chip stream A from the digester 6 had a pulp yield of 83%.

The stream of chips designated as B in FIG. 1 was spruce chips having the same dimensions as the spruce chips of stream A. The chips were passed directly to the common pressure vessel 9, after being washed in the chip washer 11. The chips in stream B were mixed in the pressure vessel 9 with the chips from stream A, in equal proportions by weight.

Excess steam was fed to the pressure vessel 9 through the line 12 from the screw feeder 8 at a superatmospheric pressure of 2.5 kp/cm$^2$.

In the pressure vessel 9, the mixture of chips A and B was subjected to a delignification in the vapor phase at a temperature of 125° C. for three minutes. Under these conditions the stream of chips B was brought to a pulp yield of approximately 95%. The resulting steam-heated mixture of partially delignified chips A and only very slightly delignified chips B were then passed to a defibrator 14, a disc refiner, by means of a screw feeder 13 at the bottom of the pressure vessel 9. The chips were defibrated in the defibrator 14 at a superatmospheric pressure of 2 kp/cm$^2$. at a temperture of approximately 120° C. The defibrated pulp was then passed to the hydrocyclone 15 for separating steam from the pulp, cooling water being passed to the hydrocyclone through the line 16.

From the hydrocyclone, the pulp was fed to a further disc refiner 17, where the pulp was further refined at atmospheric pressure, and at a temperature of approximately 85° C. and a pulp concentration of 25%. The pulp was then screened while being diluted with water in a pressure screen 18 at a 1% pulp consistency. The screened pulp was then treated in a vortex cleaner 19.

The rejects fraction from the pressure screen 18 and the vortex cleaner was dewatered to a pulp consistency of 20% and then refined in the refiner 20. The refined rejects fraction pulp was returned to the pressure screen 18.

The accepts fraction from the pressure screen 18 and the vortex cleaner 19 was dewatered to a pulp consistency of 20%, and bleached with hydrogen peroxide. The total yield of pulp thus obtained was 89%, and the brightness, 76% SCAN. The strength and optical properties of the pulp were such that the pulp could be used for the manufacture of writing and printing paper, cardboard, and soft tissue paper.

EXAMPLE 4

The manufacture of chemimechanical pulp from a batch of chips comprising one type of wood, birch, divided into two streams, both of which were partially pulped, using the process of FIG. 1.

Technical grade birch chips having an approximate size of 30 by 15 mm and a thickness of 3 mm (designated chip stream A in the flow sheet of FIG. 1) were washed in a chip washer 1, and moistened with steam in a steam-moistening vessel 2 at atmospheric pressure and a temperature of 100° C. for ten minutes. The steam-moistened chips were then passed to an impregnating vessel 4 by way of a screw feeder 3, so constructed that the chips were compressed while they were being transported to the vessel 4 so that they were dewatered from a moisture content of approximately 65% to a moisture content of approximately 50%. Subsequent to the passage through the screw feeder, the chips were allowed to expand in the impregnating vessel 4 while they were absorbing pulping liquor. The pulping liquor was passed to the vessel from a chemical preparation stage 5, and maintained at constant level in the vessel 4. As the chips swelled in the impregnation vessel, they absorbed approximately one liter of digestion liquor for each kilogram of chips. The pulping liquor comprised sulfur dioxide in admixture with sodium hydroxide, the amount of sodium hydroxide being 50 g/l calculated as $Na_2O$ and the amount of sulfur dioxide being 65 g/l. The pulping liquor had a pH of 6.0.

The impregnated chips were then led to a digester 6, in which they were subjected to a vapor phase pulping process by supplying the steam directly thereto at a superatmospheric pressure of 7.5 kp/cm$^2$ through the line 7, giving a pulping temperature of 170° C. in the digester 6. The chips were held in the digester 6 for twenty minutes.

Following the digestion, the chips were fed to the pressure vessel 9 by means of a screw feeder 8, which was of the same construction as the screw feeder 3, and which expressed surplus pulping liquor and steam from the chips en route. The pulping liquor thus removed could be used for impregnating the second stream of chips, designated as B in FIG. 1, in an impregnating vessel 23, or for preparing fresh pulping liquor in the chemical preparing stage 5, or passed directly to an apparatus 10 for recovery of spent pulping chemicals.

The stream of chips B comprised birch chips having the same dimensions as the birch chips of stream A. The stream B was washed in a chip washer 11, and moistened with steam in the steam-moistening vessel 21 at atmospheric pressure at a temperature of 100° C. for 10 minutes. The steam-moistened chips were then passed to the impregnating vessel 23 by means of the screw feeder 22, which was of the same type as the screw feeder 3. In the impregnating vessel 23, the chips were impregnated with the same kind of pulping liquor as used in the impregnating vessel 4. The impregnated chips were then passed from the impregnating vessel 23 directly to the pressure vessel 9, where the chips were mixed with the chip stream A in the proportion 30:70 by weight.

The mixture of chips was then treated with direct steam at a superatmospheric pressure of 6.5 kp/cm$^2$. The steam was admitted through the line 24. At this pressure, the temperature of the steam was 160° C. The steam digestion process was continued for 15 minutes. In this way, the total mixture was partially delignified, and the yield of the chips of stream A was approximately 79%, while the yield of the chips of stream B was approximately 90%.

The chips were defibrated in the defibrater 14 at a superatmospheric pressure of 2 kp/cm$^2$ at a temperature of approximately 120° C. The defibrated pulp was then passed to the hydrocyclone 15 for separating steam from the pulp, cooling water being passed to the hydrocyclone through the line 16.

From the hydrocyclone, the pulp was led to a further disc refiner 17, where the pulp was further refined at atmospheric pressure, and at a temperature of approximately 85° C. and a pulp concentration of 25%. The pulp was then screened while being diluted with water in a pressure screen 18 at a 1% pulp consistency. The screened pulp was then treated in a vortex cleaner 19.

The rejects fraction from the pressure screen 18 and the vortex cleaner 19 was dewatered to a pulp consistency of 20%, and then refined in the refiner 20. The refined rejects fraction pulp was returned to the pressure screen 18.

The accepts fraction from the pressure screen 18 and the vortex cleaner 19 was dewatered to a pulp consistency of 20%, and bleached with hydrogen peroxide. The total yield of pulp thus obtained was 85% and the brightness, 81% SCAN. The strength and optical properties of the pulp were such that the pulp could be used for the manufacture of writing and printing paper, cardboard and similar products.

EXAMPLE 5

The manufacture of chemimechanical pulp from three different types of wood, birch, aspen, and spruce, the birch and aspen being pulped more, and the spruce pulped less, using the process of FIG. 1.

A mixture of birch and aspen chips in the proportion 50:50 by weight having the approximate size of 50 by 15 mm and a thickness of 1 mm (designated chips stream A in the flow sheet of FIG. 1) was washed in a chip washer 1 and moistened with steam in a steam-moistening vessel 2 at atmospheric pressure and a temperature of 100° C. for ten minutes. The steam-moistened chips were then passed to an impregnating vessel 4 by way of a screw feeder 3, so constructed that the chips were compressed while they were being transported to the vessel 4, so that they were dewatered from a moisture content of approximately 65% to a moisture content of approximately 50%. Subsequent to the passage through the screw feeder, the chips were allowed to expand in the impregnating vessel 4 while they were absorbing pulping liquor. The pulping liquor was passed to the vessel from a chemical preparation stage 5, and maintained at constant level in the vessel 4. As the chips swelled in the impregnation vessel, they absorbed approximately one liter of digestion liquor for each kilogram of chips. The pulping liquor comprised sulfur dioxide in admixture with sodium hydroxide, the amount of sodium hydroxide being 50 g/l calculated as $Na_2O$ and the amount of sulfur dioxide being 65 g/l. The pulping liquor had a pH of 6.0.

The impregnated chips were then fed to the digester 6, in which they were subjected to a vapor phase pulping process by supplying steam directly thereto at a superatmospheric pressure of 7.5 kp/cm$^2$ through the line 7, giving a pulping temperature of 170° C. in the digester 6. The chips were held in the digester 6 for twenty minutes.

Following the digestion, the chips were fed to the pressure vessel 9 by means of a screw feeder 8, which was of the same construction as the screw feeder 3, and which expressed surplus pulping liquor and steam from the chips. The pulping liquor thus removed could be used for impregnating the second stream of chips, designated as B in FIG. 1, in an impregnating vessel 23, or for preparing fresh pulping liquor in the chemical preparing stage 5, or passed directly to an apparatus 10 for recovery of spent pulping chemicals.

The stream of chips B comprised spruce chips having the same dimensions as the birch and aspen chips of stream A. The stream B was washed in a chip washer 11 and moistened with steam in the steam-moistening vessel 21 at atmospheric pressure at a temperature of 100° C. for 10 minutes. The steam-moistened chips were then passed to the impregnating vessel 23 by means of the screw feeder 22, which was of the same type as the screw feeder 3. In the impregnating vessel 23, the chips were impregnated with the same kind of pulping liquor as used in the impregnating vessel 4. The impregnated chips were then passed from the impregnating vessel 23 directly to the pressure vessel 9, where the chips were mixed with the chip stream A in the proportion 30:70 by weight.

The mixture of chips was then treated with direct steam at a superatmospheric pressure of 6.5 kp/cm$^2$. The steam was admitted through the line 24. At this pressure, the temperature of the steam was 160° C. The steam-digestion process was continued for 15 minutes. In this way, the total mixture was partially delignified, and the yield of the chips of stream A was approximately 79%, while the yield of the chips of stream B was approximately 90%.

The chips were defibrated in the defibrater 14 at a superatmospheric pressure of 2 kp/cm$^2$ at a temperature of approximately 120° C. The defibrated pulp was then passed to the hydrocyclone 15 for separating steam from the pulp, cooling water being passed to the hydrocyclone through the line 16.

From the hydrocyclone, the pulp was led to a further disc refiner 17, where the pulp was further refined at atmospheric pressure, and at a temperature of approximately 85° C. and a pulp concentration of 25%. The pulp was then screened while being diluted with water in a pressure screen 18 at a 1% pulp consistency. The screened pulp was then treated in a vortex cleaner 19.

The rejects fraction from the pressure screen 18 and the vortex cleaner 19 was dewatered to a pulp consistency of 20% and then refined in the refiner 20. The refined rejects fraction pulp was returned to the pressure screen 18.

The accepts fraction from the pressure screen 18 and the vortex cleaner 19 was dewatered to a pulp consistency of 20%, and bleached with hydrogen peroxide. The total yield of pulp thus obtained was 84% and the brightness, 79% SCAN. The strength and optical properties of the pulp were such that the pulp could be used for the manufacture of writing and printing paper, cardboard and soft tissue paper.

The pulping process can be carried out in the digester in the liquid phase or in the vapor phase. In the liquid phase pulping, a less concentrated pulping liquor can be used. When the pulping is effected in the liquid phase, the chips are passed directly from the steam-moistening vessel 2 to the digester 6 through the line 26, while the pulping chemicals are passed to the digester 6 from the chemical preparation stage 5 by way of line 27. In this event, the temperature for the pulping can be within the range from about 100° to about 180° C. at a superatmospheric pressure within the range from about 0.5 to about 13 kp/cm$^2$. A suitable pulping time is from about 2 to 240 minutes.

When the chip stream A is pulped or delignified in the digester 6, there is obtained in accordance with the invention a pulp yield of from about 65 to about 92%, and preferably from about 78 to about 88%.

The chip stream B subsequent to washing in the chip washer 11 can be passed directly to the pressure vessel 9, and mixed therein with the chip stream A. It is also possible subsequent to the steam-moistening step 21 to impregnate the chip stream B with a small amount of pulping chemicals, prior to feeding this stream to the pressure vessel.

The residence time of the chip mixture in the pressure vessel 9 is not more than 20 minutes. A preferred residence time is from about 2 to about 10 minutes. In the pressure vessel 9, the superatmospheric pressure is preferably held within the range from about 0.5 to about 9 kp/cm$^2$.

The chips treated in the pressure vessel 9 and passed to the defibrator 14 may also be difibrated at atmospheric pressure, and the defibrating means may comprise a conical refiner or a screw defibrator. A suitable type is that marketed under the trademark FROTA-PULPER.

When two defibrators are used, part of the chip stream from the pressure vessel 9 can be defibrated without subjecting the chips to pressure, while the remaining chips are defibrated under pressure. When the chips are defibrated without pressure, the chips from the pressure vessel must first pass through hydrocyclone 25 to separate the steam from the chips. If desired, diluting and cooling liquids can be passed to the hydrocyclone by way of a line 16, as can also liquids containing bleaching agents, such as bleaching waste liquors, for example. Subsequent to being defibrated, the pulp may conveniently be subjected to a further defibration or beating step, for example, in a disc refiner, conical mill or screw defibrater 17, or in any other suitable form of defibrater refining or beating apparatus.

The two chip streams may also be defibrated separately, in which case each of the separate streams of chips may be subjected to a subsequent refining operation. The two pulps obtained subsequent to the defibration can also be mixed together, and processed in a common refiner.

The chips which are defibrated under pressure may subsequently be beaten individually, while the chips defibrated at atmospheric pressure may also be beaten individually. One advantage afforded by beating pulp batches separately after defibration is that the different batches can be subjected to different degrees of beating. When using two defibrators downstream of the pressure vessel, the defibrators may be set to different levels of defibration.

Since the beaten pulp may contain incompletely defibrated chip pieces called shives, it may be necessary to screen the pulp to separate the shives and recycle them. In this way there is obtained a fraction comprising coarse pulp and shives. This fraction is called reject pulp, and is normally dewatered to a relatively high pulp consistency, preferably from about 15 to about 30%, and is processed in suitable beating means, in which the shives are defibrated to single fibers. The reject fibers are then normally passed to the flow of pulp passing to the pulp screening apparatus. The screened pulp is dewatered, preferably on filters, and can then be bleached or dried directly. In an integrated cellulose processing factory, the bleached or unbleached pulp is passed to the paper mill directly after passing the screening apparatus, or after being subjected to an intermediate dewatering process.

Suitable bleaching agents for bleaching the pulp obtained include the so-called lignin-preserving bleaching agent, such as peroxides and dithionite. Other bleaching agents include the borohydrides, peracetic acid, thioglycolic acid and hydroxyl amine.

For the purpose of comparing the products obtained in accordance with the invention with those obtained using known procedures, a number of comparative laboratory runs were carried out, and the results are shown in the following Examples.

EXAMPLE 6

The process of the invention compared with Batch A, Control 3.

Spruce chips having a length of approximately 30 mm, a width of approximately 15 mm, and a thickness of approximately 2 mm, designated chip stream B, were washed and then moistened with steam at atmospheric pressure for ten minutes. The chips were pressed in a laboratory press, and were permitted to swell in an aqueous pulping liquor of pH 6.0 comprising 50 g/l sodium hydroxide (NaOH) calculated as $Na_2O$, and $SO_2$ 65 g/l. The amount of pulping solution absorbed by the chips during this impregnation was 1,000 ml per 1,000 g of dry chips.

A stream of chips designated as chip stream A comprising birch chips having the same dimensions as the spruce chips was treated in a parallel stream in exactly the same manner as the chips stream B.

In accordance with the invention, the birch chips were then pulped separately for 10 minutes, after which the chips were mixed together in a pressure vessel with the impregnated, but not pulped, spruce chips, in the proportion of 1:1 by weight. The resulting chip mixture was pulped in the vapor phase at a temperature of 160° C. corresponding to a superatmospheric pressure of 6.5 kp/cm$^2$ for 10 minutes. The total cooking time for the stream of birch chips was 20 minutes, including the 10-minute pulping period during which the chips were pulped separately, and the 10-minute period during which they were pulped together with the spruce chips.

The mixture of partially digested chips was then defibrated in a disc refiner under digester pressure while simultaneously adding diluting water. The defibrated pulp blown to a hydrocyclone for separating steam from the pulp suspension. The consistency of the suspension was approximately 30%, and the temperature was 87% C. The defibrated pulp was then refined in a second disc refiner, and diluting water was added so that the chips were refined at a pulp consistency of approximately 23%. The refined pulp was then screened and dewatered to approximately 35% pulp consistency, and then bleached with 3% hydrogen peroxide and 0.8% sodium dithionite.

The bleached pulp was beaten 500 revolutions in a laboratory mill, and formed into laboratory sheets for evaluation of its paper properties.

The table below compares the results obtained with the results from the pulp designated Batch A, Control 3. The difference between Example 6, the pulp obtained and in the process of the invention, and Batch A, Control 3, is that the birch chips in the process according to the invention were cooked separately for 10 minutes at a temperature of 160° C. and together with the spruce chips for 10 minutes at a temperature of 160° C., while the birch and spruce portions of the pulp of Batch A, Control 3, were cooked together for 20 minutes at 160° C.

The results obtained are shown in the following Table:

TABLE IV

| | Control 3 Batch A | EXAMPLE 6 |
|---|---|---|
| Pulp yield, % | 89.0 | 88.7 |
| Degree of beating, Schopper-Riegler | 40.5 | 42.0 |
| Brightness after bleaching, SCAN % | 80.4 | 80.2 |
| Breaking length, meters | 3900 | 4800 |
| Tear factor | 68 | 76 |
| Light scattering coefficient, m$^2$/kg | 36.1 | 34.8 |
| Air permeability SCAN P26:68 ml/min | 1560 | 1110 |
| Elongation, % | 3.4 | 4.0 |
| Double food number | 6 | 18 |

The results shown in the Table demonstrate that the process according to the invention provides a stronger paper than the process of Control 3, while retaining the remaining desirable properties of the pulp. Thus, the process of the invention produces a pulp which gives a strong paper having a uniform and smooth surface, and good stretchability.

EXAMPLE 7

The process according to the invention compared with Batch B, Control 3

Pine chips having a length of approximately 30 mm, a width of approximately 15 mm, and a thickness of approximately 2 mm, designated chip stream B, were washed and then moistened with steam at atmospheric pressure for ten minutes. The chips were pressed in a laboratory press, and were permitted to swell in a pulping liquor of pH 6.0 comprising 50 g/l sodium hydroxide (NaOH), calculated as $Na_2O$, and $SO_2$, and $SO_2$, 65 g/l. The amount of pulping solution absorbed by the chips during the impregnation was 1,000 ml per 1,000 g of dry chips.

A stream of chips designated as chip stream A comprising birch chips having the same dimensions as the pine chips was treated in a parallel stream in exactly the same manner as the chip stream B.

In accordance with the invention, the birch chips were then pulped separately for 10 minutes, after which the chips were mixed together in a pressure vessel with the impregnated, but not pulped, pine chips in the proportion of 1:1 by weight. The resulting chip mixture was pulped in the vapor phase at a temperature of 160° C. correspond to a superatmospheric pressure of 6.5 kp/cm$^2$ for 10 minutes. The total pulping time for the stream of birch chips was 20 minutes, including the 10-minute pulping period during which the chips were pulped separately, and the 10-minute period during which they were pulped together with the pine chips.

The mixture of partially digested chips was then defibrated in a disc refiner under digester pressure while simultaneously adding diluting water. The defibrated pulp was blown to a hydrocyclone for separating steam from the pulp suspension. The consistency of the suspension was approximately 30%, and the temperature was 87° C. The defibrated pulp was then refined in a second disc refiner, and diluting water was added so that the chips were refined at a pulp consistency of approximately 23%. The refined pulp was then screened and dewatered to approximately 35% pulp consistency, and then bleached with 3% hydrogen peroxide and 0.8% sodium dithionite.

The bleached pulp was beaten 500 revolutions in a laboratory mill, and formed into laboratory sheets for evaluation of its paper properties. The Table below compares the results obtained with the pulp designated as Batch B, Control 3. The difference between the pulp obtained in the process of the invention and that obtained in Batch B, Control 3, is that the birch chips in the process according to the invention were cooked separately for 10 minutes at a temperature of 160° C. and together with the pine chips for 10 minutes at a temperature of 160° C., while the birch and pine portions of the pulp of Batch B, Control 3, were cooked together for 20 minutes at 160° C.

The results of the experiments are shown in the following Table.

TABLE V

| | Control 3 Batch B | EXAMPLE 7 |
|---|---|---|
| Pulp yield, % | 89.5 | 89.0 |
| Degree of beating, Schopper-Riegler | 14.5 | 26.0 |
| Brightness after bleaching, SCAN % | 77.5 | 77.8 |
| Breaking length, meters | 3100 | 3900 |
| Tear factor | 63 | 70 |
| Light scattering coefficient, m$^2$/kg | 33.4 | 33.6 |
| Air permeability, SCAN-P26:68 ml/min | >3000 | 1820 |
| Elongation, % | 2.7 | 3.3 |
| Double fold number | 0 | 7 |

The data in the Table show that the pulp produced in accordance with the invention yields a stronger paper exhibiting good surface smoothness, good elongation, and a high toughness, while retaining good optical properties. Using a mixture of pine chips and birch chips, a considerably higher degree of beating is obtained in the pulp in accordance with the invention than in the pulp produced in accordance with Batch B, Control 3.

EXAMPLE 8

The process of the invention compared with a mixture of mechanical and chemical pulp.

In the manufacture of paper, mechanical pulp is often mixed with chemical pulp to produce wood paper, the chemical pulp giving the paper its strength, while the mechanical pulp mostly contributing to good formation, i.e., a good uniform distribution of the fibers in the paper, and a high degree of opacity.

A control run was carried out in which there was produced a mixture of 35% peroxide bleached mechanical pulp having a brightness of 80% SCAN and 65% chemical pulp having a brightness of 91% SCAN. This mixture was beaten 500 revolutions in a laboratory mill, after which laboratory sheets wre formed. These sheets were tested for paper properties, and the results were compared with the results obtained with the paper produced in accordance with the invention in Example 6.

The results obtained are compared in the Table below:

TABLE VI

| | Mechanical/ chemical pulp | EXAMPLE 6 |
|---|---|---|
| Pulp yield, % | 65 | 88.7 |
| Degree of beating, Schopper-Riegler | 31 | 42 |
| Brightness, after bleaching, SCAN % | 83 | 80.2 |
| Breaking length, meters | 3200 | 4800 |
| Tear factor | 76 | 76 |
| Light scattering coefficient, m$^2$/kg | 41.2 | 34.8 |
| Air permeability SCAN P26:68, ml/min | 1150 | 1110 |

The results show that the tensile strength of paper manufactured from the pulp produced in accordance with the invention is higher than the tensile strength of a conventional wood cellulose paper. The only properties which were somewhat impaired were the opacity and the brightness. Thus, using the process according to the invention, it is possible to produce a high quality paper exhibiting properties equivalent to those obtained by mixing mechanical and expensive chemical pulps, and this at a total pulp yield, which is approximately 24% higher.

It is not at present understood why the process of the invention gives a pulp which, in addition to being readily bleached and readily beaten and exhibiting favorable optical properties, also has such a high mechanical strength that it can be used for the manufacture of writing and printing paper without the addition of reinforcing pulp of high mechanical strength. It may be that the beating process carried out in the process according to the invention is more efficient, since two kinds of chips that have been delignified to different degrees or not at all delignified are defibrated and refined together; the chips that are pulped less, or unpulped, which are harder, assist in defibrating the chips which are pulped more, and are softer. The harder chips may also assist in fibrillating the individual fibers, and fibrillation may occur at an earlier stage of the defibrating and refining process than when relatively soft chips are beaten separately.

A further factor contributing to the favorable results may be that the softer chips fill the the disc pattern in the disc refiner more rapidly than do the hard chips. When the discs are filled rapidly, the energy applied by the refiner is used more effectively, and a larger working area and a longer residence time are obtained during passage of the pulp through the grinder. It is also possible that different types of fibers coming into intimate contact with each other during the defibration process develop binding potentials between the fibers, which is not possible when the chips are defibrated and beaten separately.

An important advantage of the process of the invention is that it produces a high pulp yield, which is important in view of the scarcity of wood in comparison to the mounting demand. Thus, each expedient that makes it possible to recover a larger percentage of the pulp from natural wood is of great significance.

By the process of the invention, it is possible to produce a high yield pulp which provides paper exhibiting good mechanical strength, good surface smoothness, good elongation, low brittleness, and good optical properties. In addition, the pulp is also readily beaten and bleached. In certain cases, the process according to the invention produces a pulp with lower energy input than other known processes. Since, in accordance with the invention, different types of wood can be combined to advantage, the invention also allows an effective recovery of available raw materials in forest stands of several types of wood, and this even when the various types are present in small amounts. Another advantage afforded by the invention is that the cooking waste liquor obtained has a higher solids content, thereby improving heat economy in recovery of the pulping chemicals. The pulping liquor also has a higher extract content than the pulping liquors used in joint cooking processes, which results in a lower extract content of the finished pulp.

In the process of the invention, the same equipment can to a very large extent be used for the separate process steps, as opposed to other processes, in which different types of pulp from different mills are mixed together. The chemical preparation plant, the common pressure vessel, and the disc refiners are examples of apparatus which are commonly used in the different process steps. Other apparatus which are used in common in the process of the invention are the screening plant, the pulp drying system, and the chemicals recovery system.

Figure 2:
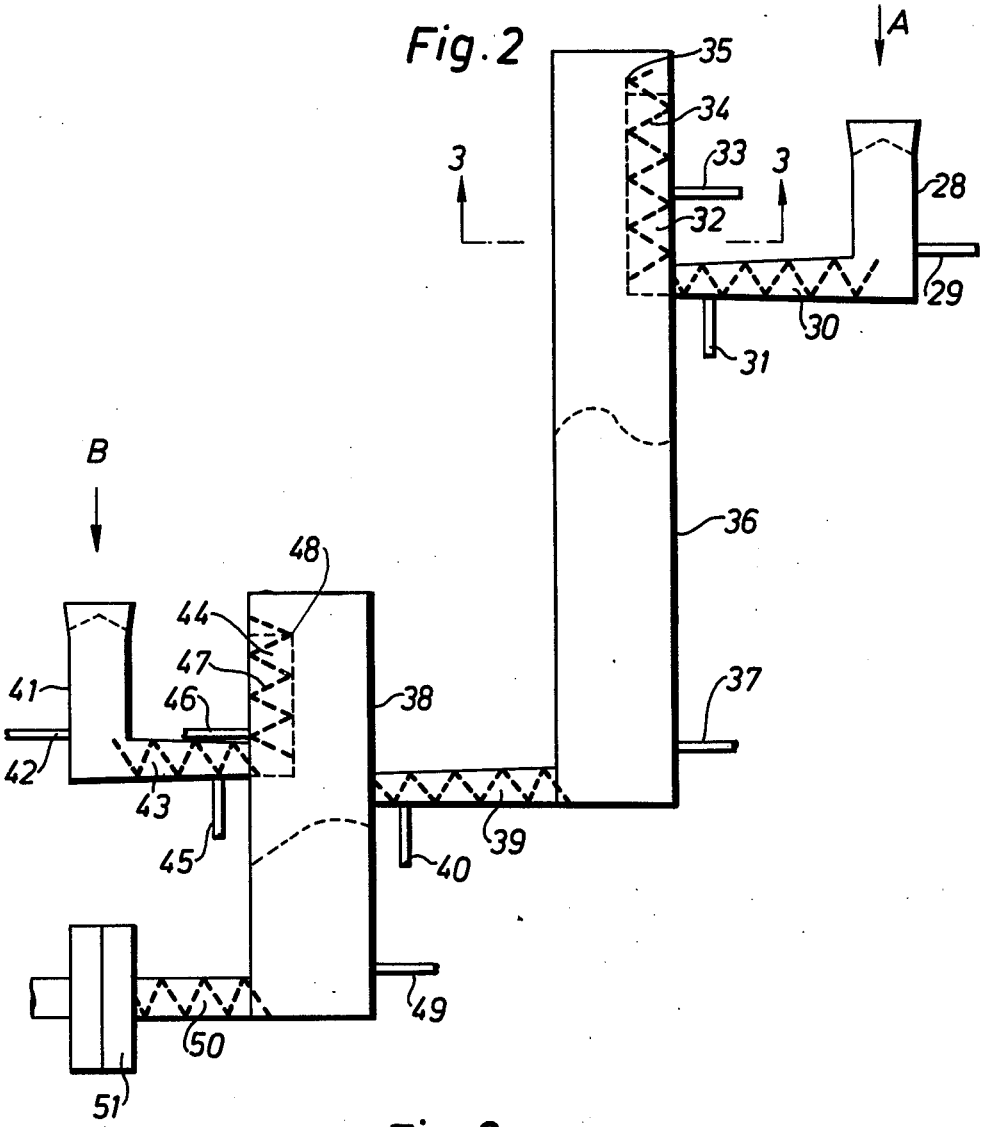
FIG. 2 is a schematic view in longitudinal section showing apparatus for carrying out the process of the invention.
Figure 3:
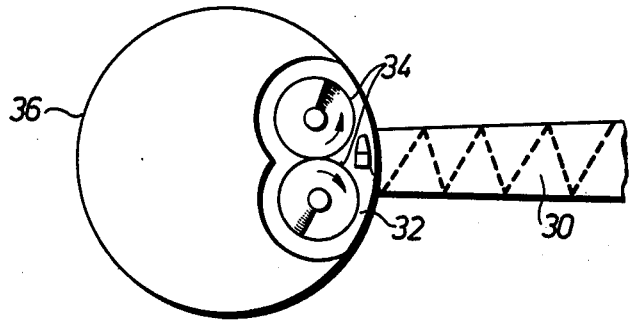
FIG. 3 is a cross-sectional view taken along the line 3—3 of FIG. 2.

The apparatus for carrying out the process of the invention shown in FIGS. 2 and 3 comprises two vertical pressure vessels 36, 38, within the upper portion of which there is arranged an impregnating vessel 32, 44, which is provided with a solution inlet line 33, 46 and vertical conveyer screws 34, 47, into which chips can be fed via a dewatering screw feeder 30, 43 from a steam-moistening vessel 28, 41 with steam inlet line 29, 42, and into which a stream A, B of chips to be pulped is passed.

Arranged in the bottom of the pressure vessel 36, 38 is a screw conveyer 39, 50 for conveying material under pressure from the bottom of the pressure vessel, from vessel 36 to vessel 38, and from vessel 38 to a defibrator 51.

Operation of the apparatus is as follows:

Particulate lignocellulosic material such as wood chips are washed and then divided into two streams A and B, which are fed into the apparatus as streams A and B in FIG. 2.

The chip stream A passes to the steam-moistening vessel 28, in which the chips are treated with steam conveyed to the vessel through the line 29. The steam-moistened chips are then transported to the impregnating chamber 32 by the screw feeder 30, while simultaneously being dewatered thereby. The water squeezed out from the chips is collected and recycled by way of the line 31.

An aqueous solution containing the impregnating pulping chemicals is passed to the impregnating chamber 32 by way of the line 33. The impregnated chips are passed through the impregnating pulping liquor by means of vertically extending conveyer screws 34. The impregnated chips then pass over the upper edge 35 of the impregnating chamber 32, and descend through the digester 36. The positioning of the impregnating chamber 32 and the two vertical conveyer screws 34 in the digester 36 is more clearly shown in FIG. 3, which is a cross-sectional view of the digester 36 taken along the line 3—3 of FIG. 2.

Steam is passed to the digester 36 through the line 37, for heating the chips during the digestion. To ensure that the chips have been digested to the desired extent when the chips reach the bottom of the vessel, the dwell time of the chips which are continuously descending through the digester 36 is adjusted by the speed of rotation of the screw feeder 39 which draws the chips from the digester 36 to the pressure vessel 38. During their passage through the screw feeder 39, a portion of the cooking liquor is squeezed from the partially digested and softened chips. The cooking waste liquor squeezed from the chips is recovered by way of line 40, and recycled after regeneration and chemicals recovery.

The chip stream A is mixed in the pressure vessel 38 with the chip stream B. The chip stream B passes through a steam-moistening vessel 41, to which steam is passed through a line 42, and the chips are conveyed to an impregnating chamber 44 by means of a dewatering screw feeder 43. The water squeezed from the chips is led off by the line 45, and recycled. The impregnating chamber 44 may contain impregnating pulping chemicals, or only water, as desired. The impregnating liquor, whether water of pulping liquor, is passed to the chamber 44 by the line 46.

The chips are conveyed through the impregnating chamber 44 by means of two vertically extending conveyer screws 47, similar to those shown in FIG. 3.

After passing through the impregnating chamber 44, the chips are carried over the upper edge 48 of the chamber and then descend through the common pressure vessel 38, where they are mixed with the chips of chip stream A, which are subjected to a further partial digestion during traverse of vessel 38.

Steam is supplied to the pressure vessel 38 through the line 49, and the mixture of chips is treated with heat under pressure. After the pressure treatment the partially digested chips are passed by the screw feeder 50 to the defibrator 51. The dwell time in vessel 38 is adjusted by the feed rate of the screw feeder 50. The pulp from the defibrator is passed through a hydrocyclone (not shown) to separate steam from the pulp, after which the pulp may optionally be refined in a further refining stage, and is then screened and bleached.

At the ends of the screw feeders 30 and 43 connected to the digester 36 and the pressure vessel 38, respectively, sealing means are provided, which make it impossible for steam to escape from the screw feeders, but these seals are not shown in FIG. 2.

Having regard to the foregoing disclosure, the following is claimed as the inventive and patentable embodiments thereof:

1. A process for preparing cellulose pulps having a yield within the range from about 70 to about 93% from raw lignocellulosic material which comprises subjecting to a vapor phase pulping by heating under a superatmospheric pressure within the range from about 1 to about 11 atmospheres at a temperature within the range from about 90 to about 200° C. a mixture of at least two separate portions of particulate lignocellulosic material, of which at least one portion is unpulped and at least one portion is separately partially chemically pulped to a yield within the range from about 65 to about 92%; and then directly subjecting the heat-treated incompletely pulped mixture, of which said partially chemically pulped portion is softer than the other portion, to a mechanical defibration sufficient to convert the raw lignocellulosic material to a high yield cellulose pulp having a yield within the range from about 70% to about 93%, the heating under pressure being so effected that the final yield of the partially pulped portion is within the range from about 60 to about 88%, and the final yield of the unpulped portion is within the range from about 85 to about 100%.

2. A process according to claim 1, in which the unpulped and the partially pulped portions are of the same type of lignocellulosic material.

3. A process according to claim 1, in which the unpulped and the partially pulped portions are of different types of lignocellulosic material.

4. A process according to claim 1, in which the partially pulped portion of raw lignocellulosic material in particulate form is washed, moistened with steam, impregnated with pulping chemicals, and then partially pulped and mixed without intermediate washing with the unpulped portion of lignocellulosic material which has been washed.

5. A process according to claim 4, in which the unpulped and partially pulped portions are of the same type of lignocellulosic material.

6. A process according to claim 4, in which the unpulped and partially pulped portions are of different types of lignocellulosic material.

7. A process according to claim 4, in which the unpulped portion of lignocellulosic material prior to mixing with the partially pulped portion is impregnated with pulping chemicals subsequent to being washed and moistened with steam at a temperature within the range from about 90° to about 110° C. for at least five minutes, so that a partial pulping and softening of the unpulped portion is obtained after mixing with the partially pulped portion during the heating under pressure.

8. A process according to claim 4, in which the heating under pressure is effected for from about 1 to about 20 minutes.

9. A process according to claim 4 in which, prior to the second pulping of the partially pulped portion of lignocellulosic material, the excess pulping chemicals are removed and recycled.

10. A process according to claim 4, in which the partial pulping of the partially pulped portion is effected with pulping chemicals selected from at least one of the groups consisting of chemicals for sulfate pulping; chemicals for sulfite pulping, and chemicals for oxygen gas/alkali pulping.

11. A process according to claim 1, in which the mechanically defibrated mixture is subjected to bleaching.

12. A process according to claim 11, in which the bleaching is effected with lignin-preserving bleaching agents.

13. A process according to claim 1, in which two of the portions of lignocellulosic material are softwood.

14. A process according to claim 1, in which two of the portions of lignocellulosic material are hardwood.

15. A process according to claim 1, in which one of the portions of lignocellulosic material is hardwood, and another is softwood.

16. A process according to claim 1, in which the lignocellulosic material is in the form of chips having a size within the range from about 15 to 30 mm by from about 20 to 40 mm, with a thickness within the range from about 0.5 to about 10 mm.

17. A process according to claim 1 in which the mechanically defibrated mixture is subjected to an additional mechanical defibration.

18. A process according to claim 17 in which the mechanically defibrated mixture is subjected to bleaching.

19. A process according to claim 1, which comprises heating at a pressure within the range from about 1.5 to about 9 atmospheres.

20. A process according to claim 1, in which the partially pulped portion of raw lignocellulosic material in particulate form is washed, moistened with steam, impregnated with pulping chemicals, and then partially pulped and mixed without intermediate washing with the unpulped portion of lignocellulosic material which has been washed and moistened with steam.

21. A process according to claim 20, in which the unpulped and partially pulped portions are of the same type of lignocellulosic material.

22. A process according to claim 20, in which the unpulped and partially pulped portions are of different types of lignocellulosic material.

23. A process according to claim 20, in which the unpulped portion of lignocellulosic material prior to mixing with the partially pulped portion is impregnated with pulping chemicals subsequent to being washed and moistened with steam at a temperature within the range from about 90° to about 110° C. for at least five minutes, so that a partial pulping and softening of the unpulped portion is obtained after mixing with the partially pulped portion during the heating under pressure.

24. A process according to claim 20, in which the heating under pressure is effected for from about 1 to about 20 minutes.

25. A process according to claim 20, in which prior to the second pulping of the partially pulped portion of lignocellulosic material, the excess pulping chemicals are removed and recycled.

26. A process according to claim 20, in which the partial pulping of the partially pulped portion is effected with pulping chemicals selected from at least one of the groups consisting of chemicals for sulfate pulping; chemicals for sulfite pulping, and chemicals for oxygen gas/alkali pulping.

* * * * *

UNITED STATES PATENT AND TRADEMARK OFFICE

CERTIFICATE OF CORRECTION

PATENT NO. : 4,152,197

DATED : May 1, 1979

INVENTOR(S) : Jonas A.I. Lindahl et al

It is certified that error appears in the above-identified patent and that said Letters Patent are hereby corrected as shown below:

| | | |
|---|---|---|
| [56] line 6 | : | "Villavieencio et al" should be --Villavicencio et al-- |
| line 12 | : | "Rautalahati et al" should be --Rautalahti et al-- |
| [57] line 7 | : | "is" should be -- in-- |
| Column 1, line 63 | : | "palped" should be --pulped-- |
| line 68 | : | "premutations" should be --permutations-- |
| Column 2, line 11 | : | "steam or;" should be --steam; or -- |
| line 46 | : | Add --material-- after "lignocellulosic" |
| Column 5, line 40 | : | "dithioate" should be --dithionite-- |
| Column 7, lines 11-12 | : | " birch chips are pulped more, using the process of FIG. 1." |

should be

-- birch chips are pulped more, using the process of FIG. 1. --

UNITED STATES PATENT AND TRADEMARK OFFICE

CERTIFICATE OF CORRECTION

PATENT NO. : 4,152,197

DATED : May 1, 1979

INVENTOR(S) : Jonas A.I. Lindahl et al

It is certified that error appears in the above-identified patent and that said Letters Patent are hereby corrected as shown below:

| | | |
|---|---|---|
| Column 15, line 46 | : | "$SO_2$65 g/l" should be --$SO_2$ 65 g/l-- |
| Column 16, line 3 | : | "87%C" should be --87°C-- |
| line 57 | : | delete "and $SO_2$" second occurrence |
| Column 20, line 27 | : | "of" should be --or-- |

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*